US007045744B2

(12) United States Patent
Oh

(10) Patent No.: US 7,045,744 B2
(45) Date of Patent: May 16, 2006

(54) HAIR CURLING IRON WITH TWO ROTATABLE AND VERTICALLY MOVABLE TONGS

(76) Inventor: Young Ho Oh, #125 - 605 Halla-Maeul Apartment, Jung 4-dong, Wonmi-gu, Bucheon, Gyeonggi-do (KR)

( * ) Notice: Subject to any disclaimer, the term of this patent is extended or adjusted under 35 U.S.C. 154(b) by 0 days.

(21) Appl. No.: 10/832,981

(22) Filed: Apr. 27, 2004

(65) Prior Publication Data

US 2004/0251245 A1 Dec. 16, 2004

(30) Foreign Application Priority Data

Apr. 30, 2003 (KR) ..... 20-2003-0013490 U

(51) Int. Cl.
*A45D 1/04* (2006.01)

(52) U.S. Cl. ..... 219/225; 219/524

(58) Field of Classification Search ..... 219/225, 219/222, 524; 132/224–241, 269
See application file for complete search history.

(56) References Cited

U.S. PATENT DOCUMENTS 4,267,431 A * 5/1981 Rick et al. ..... 219/225
4,442,849 A * 4/1984 Kawabe ..... 132/232
4,591,695 A * 5/1986 Inoue ..... 219/225
4,829,156 A * 5/1989 Thompson ..... 219/225
4,866,249 A * 9/1989 Howard ..... 219/225
5,649,555 A * 7/1997 Harris ..... 132/238
6,627,852 B1 * 9/2003 Savone ..... 219/225

FOREIGN PATENT DOCUMENTS

CA 1084381 * 8/1980
CA 2183904 * 8/1998
GB 2106384 * 4/1983

* cited by examiner

*Primary Examiner*—John A. Jeffery
(74) *Attorney, Agent, or Firm*—The Webb Law Firm

(57) ABSTRACT

The object of this invention is to provide a hair curling iron having a pair of curling tongs and a heat generating means mounted on the tongs, comprising a tong control unit to control the up and down movement of the curling tongs; a rotary body connected to the tong control unit to rotatably support the tongs; a fixed body to support the rotary body so that the rotary body rotates on its own axis; a drive motor mounted at a predetermined portion of the fixed body to rotate the rotary body; and a drive button to actuate the drive motor.

6 Claims, 6 Drawing Sheets

HAIR CURLING IRON WITH TWO ROTATABLE AND VERTICALLY MOVABLE TONGS

BACKGROUND OF THE INVENTION

1. Field of the Invention

The present invention relates to hair curling irons, and more particularly, to hair curling irons comprising a couple of curling tongs that are designed to rotate upward and downward to the fixed angle relative to each other, and further, to rotate as combined together on their own rotating axis, and which allows to create various hairstyles, such as a straight hairstyle, a wavy hairstyle and a curly hairstyle without using various shapes of curling irons.

2. Description of the Related Art

As conventional one, a hair curling iron has scissor-like construction by having the first and the second tongs, one or both of which are to move upward or downward to the fixed angle. The heat of the tongs may be provided by a heat generating system mounted thereon, or may be provided from outside. For making or changing a hairstyle, hairs are to be secured and stranded between the scissor-like tongs heated to the predetermined temperature. When hairs are secured and stranded between the tongs, the pressure and the heat of the tongs make the hairstyle of the desired one.

In such a conventional hair curling iron, however, the tongs are not supposed to rotate as combined together on their own axis, and therefore, despite that hair rolling is important in making or changing hairstyles, it has been difficult to roll hairs in using the conventional hair curling iron.

Because of such problem, in a conventional hair curling iron, to make various hairstyles, one should prepare several kinds of hair curling irons having various shapes of tongs, such as a round wave shape or a triangular wave shape. The style of hair changes according to the shape of the tongs. Therefore, in using the conventional hair curling iron, one may change several times the curling irons from one shape to another to complete one hairstyle, which makes it very burdensome to use the conventional one.

SUMMARY OF THE INVENTION

Accordingly, the present invention has been made keeping in mind the above problems occurring in the prior art, and an object of the present invention is to provide a hair curling iron comprising a couple curling tongs that are designed to rotate upward and downward to the fixed angle relative to each other, and further, to rotate as combined together on their own rotating axis, and which allows to create easily various hairstyles, such as a straight hairstyle, a wavy hairstyle and a curly hairstyle without using various shapes of curling irons.

In order to accomplish the above object, the present invention provides a hair curling iron having a pair of curling tongs and a heat generating means mounted on the tongs, comprising a tong control unit to control the up and down movement of the curling tongs; a rotary body connected to the tong control unit to rotatably support the tongs; a fixed body to support the rotary body so that the rotary body rotates on its own rotating axis; a drive motor mounted at a predetermined portion of the fixed body to rotate the rotary body; and a drive button to actuate the drive motor.

The tong control unit of the present invention comprises a tong-returning unit to apply a force to the pair of curling tongs so that the curling tongs return to the original closed position; and a tong-opening unit to provide a rotating force to the curling tongs so that the curling tongs rotate relative to each other by moving the curling tongs upward and downward respectively.

In the present invention, an elastic spring may be used as the tong-returning unit. The tong-opening unit of the present invention includes a pair of driven units which extend from the pair of curling tongs and placed at the opposite side of the curling tongs in regard to the rotating axis, and which have driven slope surfaces provided at predetermined positions of each of the driven units to be outwardly inclined from the rotating axis; a drive unit having a drive slope surface to be in contact with the pair of driven units correspondently to have the driven units move inward when it slides back along the rotating axis; and a rotating button designed to have the drive unit slide back along the rotating axis when pulled. Because the tong-returning unit has elastic force to return to the original closed position, the rotating button is to back to original position when the pulling power disappears.

The rotary body of the present invention includes a rotating shaft which connects the curling tongs and a driven bevel gear which is also connected to a drive bevel gear so that the curling tongs rotate on the rotating axis when the bevel gears are driven by the drive motor. The drive bevel gear is coupled to the drive motor via a reduction gear unit.

The hair curling iron of the present invention may include a pair of safety units which surround outer parts of the curling tongs in such a way as to be separated from the curling tongs, if necessary. Each of the safety units should be made of materials of low heat conductivity and less heat deformation.

In case of using such safety units, it would be preferable that a plurality of fitting depressions are provided along each of the curling tongs, and a plurality of fitting projections are provided on each of the safety units to be inserted in the corresponding fitting depressions, by which the safety units can be separated easily from the curling tongs.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
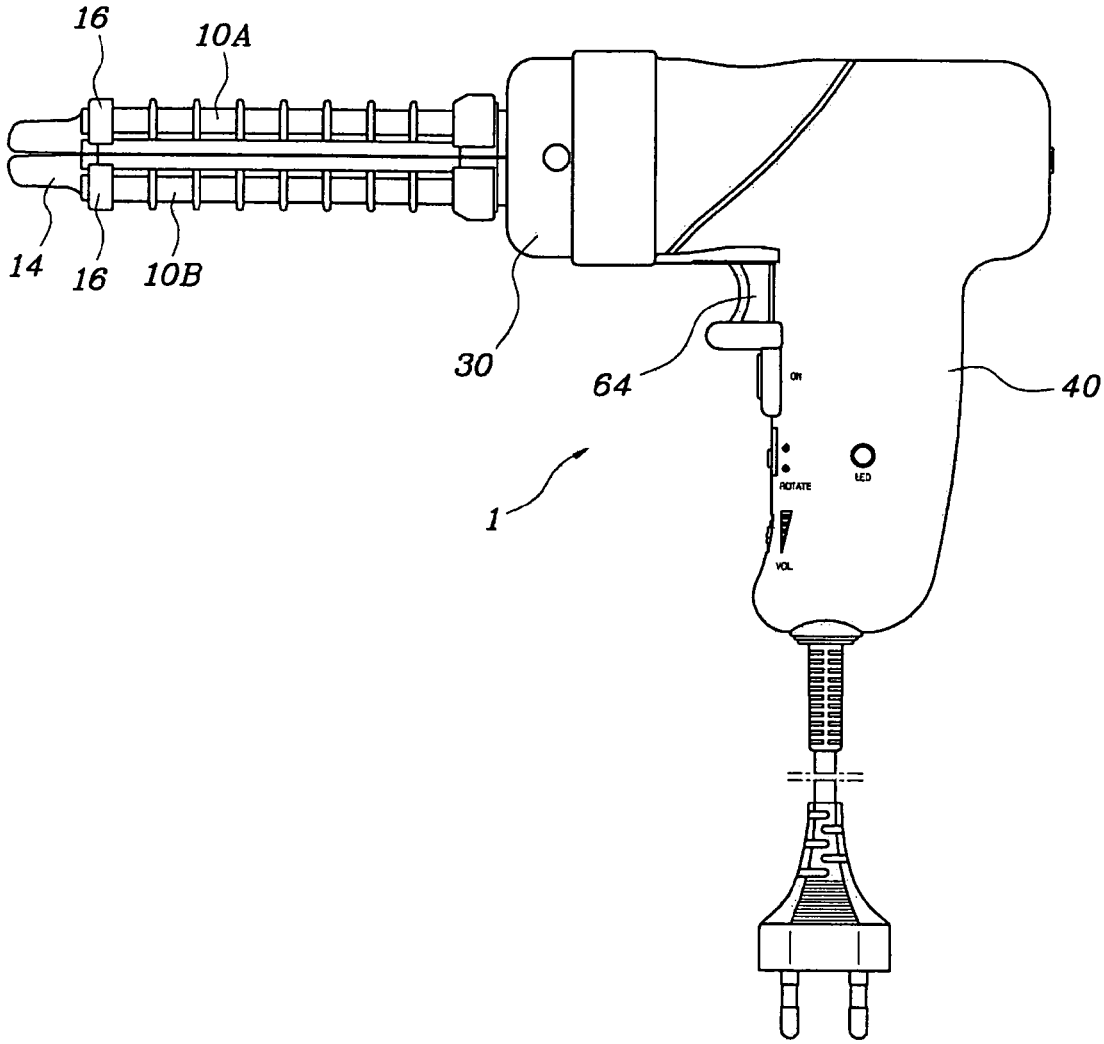
FIG. 1 is a schematic view of a hair curling iron, according to the present invention.

Hereinafter, embodiments of the present invention will be described in detail with reference to the attached drawings.

Reference now should be made to the drawings, in which the same reference numerals are used throughout the different drawings to designate the same or similar components.

Figure 2:
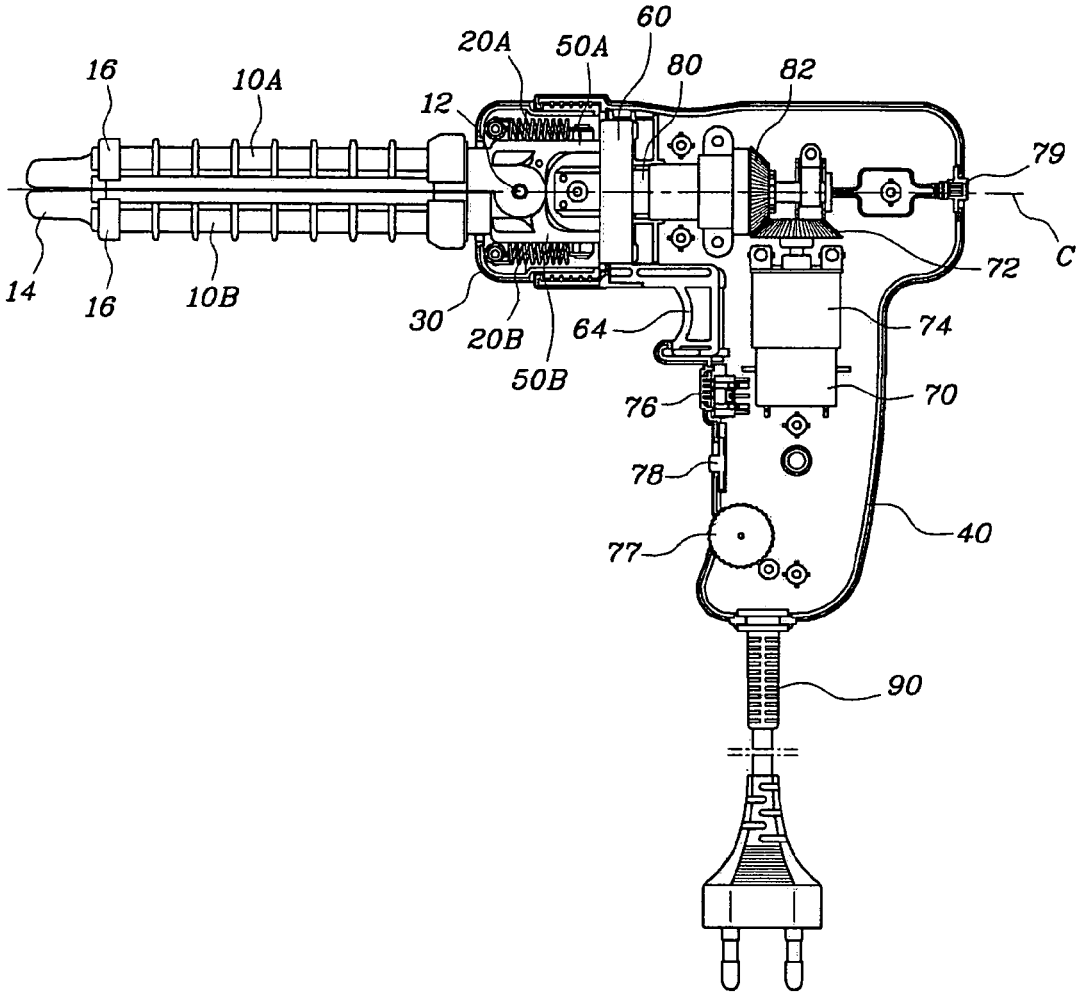
FIG. 2 is a sectional view of the hair curling iron of FIG. 1.

FIG. 1 is a schematic view of a hair curling iron, according to the present invention, and FIG. 2 is a sectional view of the hair curling iron of FIG. 1.

The hair curling iron 1 of the present invention includes a pair of curling tongs, namely the first and the second curling tongs 10A and 10B which have a predetermined length. Each of the curling tongs 10A and 10B is coupled, at the first end thereof, to a rotary body 30 of the hair curling iron 1 via a rotary support pin 12 which is provided at a predetermined portion of the rotary body 30. The first and the second curling tongs 10A and 10B rotate about the rotary support pin 12. Further, a heating plate, which is not shown in the drawings and generates heat when electricity is supplied, is attached to each of contact parts between the first and second curling tongs 10A and 10B.

Preferably, the first and the second curling tongs 10A and 10B are constructed so that the curling tongs 10A and 10B have a semicircular cross-section, and flat parts of the curling tongs 10A and 10B are in contact with each other.

Further, the rotary body 30 is rotatably mounted to a fixed body 40 acting as a handle, thus rotating about a rotating axis C.

An arc-shaped protective tip 14 is provided at a second end of each of the first and the second curling tongs 10A and 10B. The protective tip 14 is made of materials of less heat deformation.

Further, each of the first and the second curling tongs 10A and 10B is provided with a safety unit 16 made of materials of low heat conductivity and less heat deformation. The safety units 16 surround parts of the first and the second curling tongs 10A and 10B except the contact parts between the first and the second curling tongs 10A and 10B. Preferably, the safety units 16 are constructed to be separated from the first and the second curling tongs 10A and 10B, if necessary.

Referring to FIGS. 1 through 5, a plurality of fitting depressions 11 are provided along each of the first and the second curling tongs 10A and 10B. Further, each of the safety units 16 is provided with a plurality of fitting projections 17 which are inserted in the corresponding fitting depressions 11. Each of the fitting depressions 11 has a cross-section which is tapered outward, while each of the fitting projections 17 has a cross-section which is tapered outward so as to correspond to each of the fitting depressions 11, thus engaging with an associated fitting depression 11 in a dovetail jointing manner. Thus, after the safety unit 16 is mounted to each of the first and second curling tongs 10A and 10B, only a longitudinal sliding movement of each safety unit 16 is permitted, thus preventing the safety unit 16 from being undesirably removed from each of the first and the second curling tongs 10A and 10B.

Figure 3:
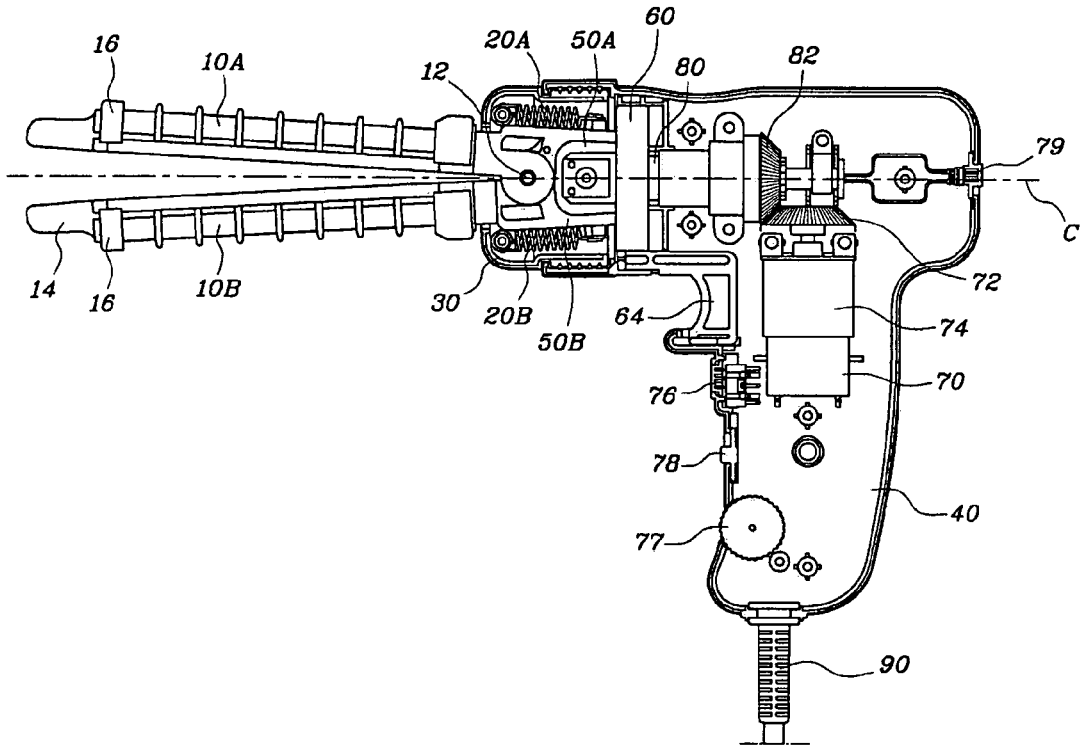
FIG. 3 is a sectional view of the hair curling iron of FIG. 1, when curling tongs of the hair curling iron are opened.

The first and the second curling tongs 10A and 10B are rotated by a tong control unit. The tong control unit makes the first and the second curling tongs 10A and 10B approach each other so that the first and the second curling tongs 10A and 10B come into contact with each other. Further, the tong control unit makes the first and the second curling tongs 10A and 10B move away from each other so that the first and the second curling tongs 10A and 10B are opened at a predetermined angle. When the first and the second curling tongs 10A and 10B are in contact with each other as shown in FIG. 2, such a state will be referred to as a 'closed state' hereinafter. Meanwhile, when the first curling tong 10A is at a predetermined angle with the second curling tong 10B as shown in FIG. 3, such a state will be referred to as an 'open state' hereinafter.

The tong control unit includes a tong-returning unit and a tong-opening unit. The tong-returning unit functions to return the first and the second curling tongs 10A and 10B to original positions thereof, for example, the closed state, and maintain the closed state. Meanwhile, the tong-opening unit provides a rotating force to the first and the second curling tongs 10A and 10B so that the curling tongs 10A and 10B rotate in opposite directions while overcoming the force applied by the tong-returning unit, thus resulting in the open state.

The tong-returning unit includes the first and the second elastic springs 20A and 20B. The first and the second elastic springs 20A and 20B provide elastic forces to the first and the second curling tongs 10A and 10B, respectively, so that the first and the second curling tongs 10A and 10B return to the closed state. The first ends of the first and the second elastic springs 20A and 20B are coupled to the first and the second curling tongs 10A and 10B, respectively, while the second ends of the first and the second elastic springs 20A and 20B are coupled to predetermined portions of the rotary body 30. As another example of the tong-returning unit, the tong-returning unit may have a single elastic spring. The elastic spring is constructed so that the first end thereof is coupled to the first curling tong 10A and the second end thereof is connected to the second curling tong 10B. Thereby, the first and the second curling tongs 10A and 10B return to the closed state by the single elastic spring.

The tong-opening unit includes the first and the second driven units 50A and 50B, a drive unit 60, and a rotating button 64. The first and the second driven units 50A and 50B extend from the first and the second curling tongs 10A and 10B, respectively, to move along with the first and the second curling tongs 10A and 10B, and are placed to be symmetric with respect to the rotating axis C. The drive unit 60 drives the first and the second driven units 50A and 50B to rotate the first and the second curling tongs 10A and 10B. Further, the rotating button 64 moves the drive unit 60 along the rotating axis C.

Figure 4:
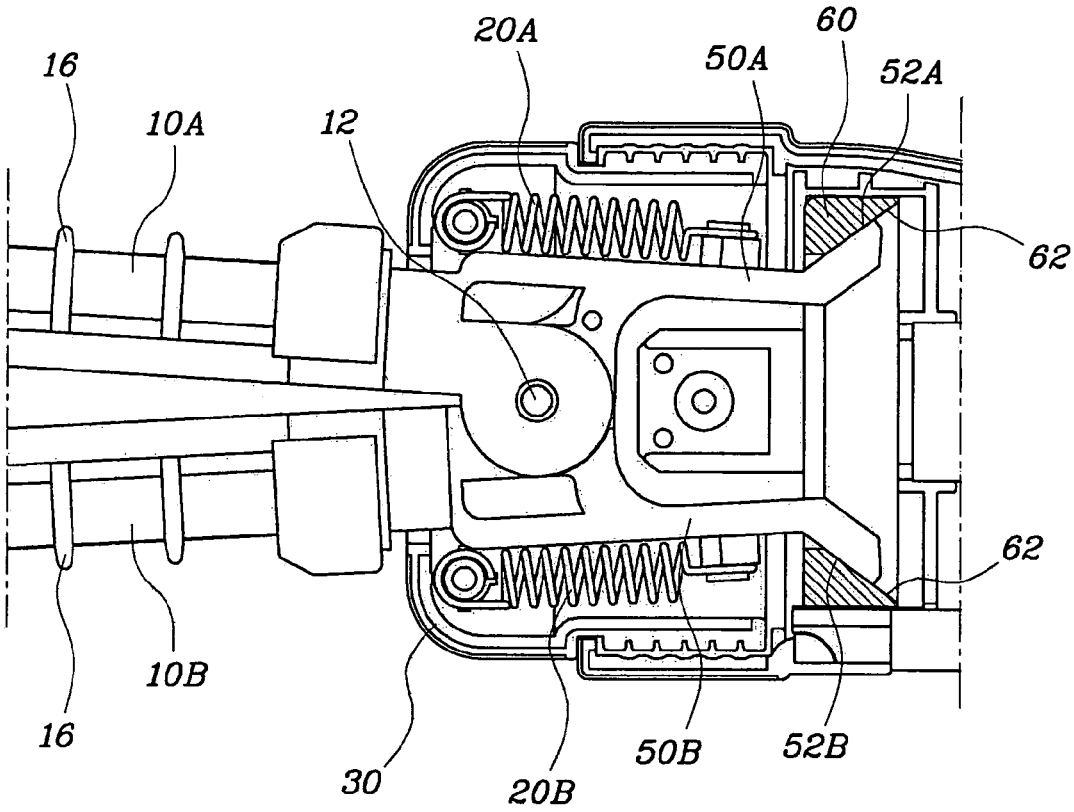
FIG. 4 is an enlarged detail view of a part of the hair curling iron of FIG. 1.
Figures 5, 5A:
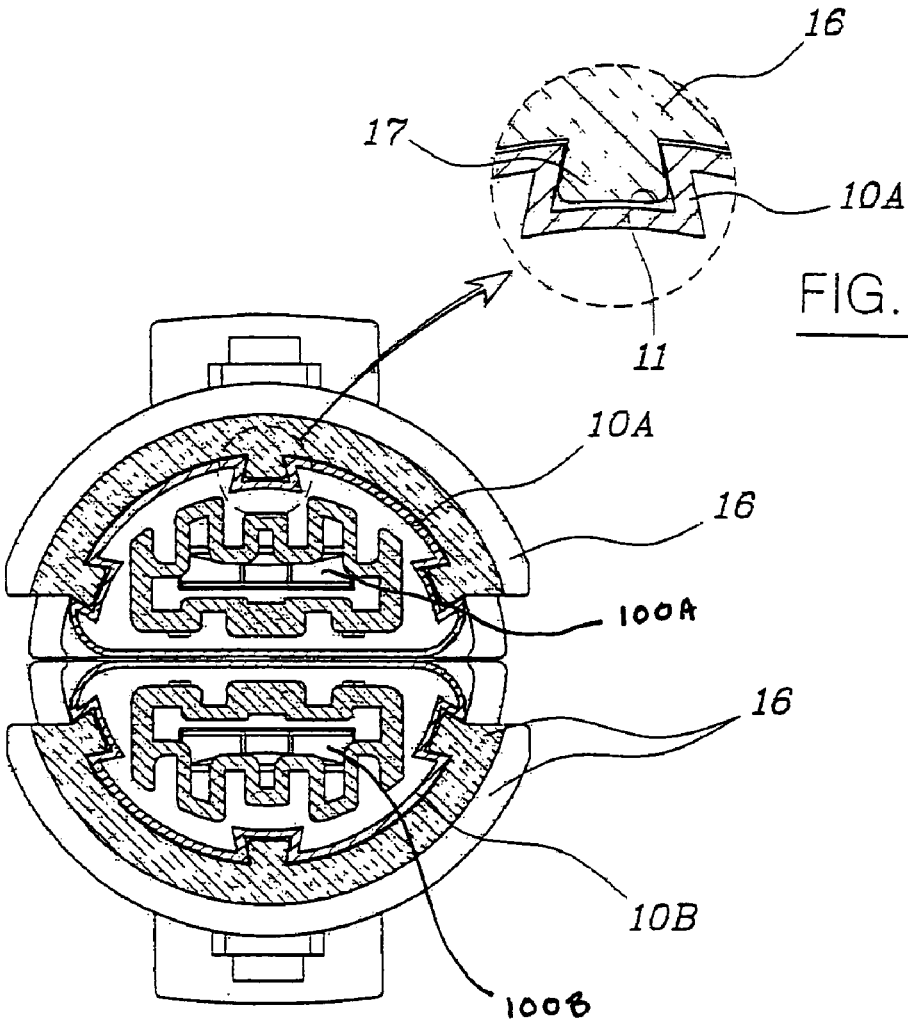
FIG. 5 is a detailed sectional view to show the curling tongs of the hair curling iron of FIG. 1 and safety units mounted to the curling tongs.
FIG. 5A is a further detailed sectional view of the safety units mounted to the curling tongs of FIG. 5.

As shown in FIG. 4 in detail, when the first and the second curling tongs 10A and 10B rotate to be near to each other, that is, the first and the second curling tongs 10A and 10B are closed, the first and the second driven units 50A and 50B move away from each other. Further, the first and the second driven slope surfaces 52A and 52B are respectively provided at ends of the first and the second driven units 50A and 50B. The first and the second driven slope surfaces 52A and 52B are formed to be flared from the rotating axis C in a direction distant from the rotary support pin 12.

Further, the drive unit 60 is mounted to a predetermined portion of the fixed body 40 to slide along the rotating axis C. The drive unit 60 includes a drive slope surface 62 which surrounds the first and the second driven slope surfaces 52A and 52B to be in surface contact with the first and the second driven slope surfaces 52A and 52B.

The rotating button 64 is integrated with the drive unit 60 to be outwardly projected from the fixed body 40. Thus, when the rotating button 64 is pulled toward the fixed body 40 using fingers, the drive unit 60 slides along the rotating axis C.

Of course, the first and the second driven slope surfaces 52A and 52B and the drive slope surface 62 must be formed smooth so that the first and the second driven slope surfaces 52A and 52B smoothly slide and rotate relative to the drive slope surface 62. Preferably, the first and the second driven slope surfaces 52A and 52B and the drive slope surface 62 are coated with a metal material, thus preventing the abrasion of the first and the second driven slope surfaces 52A and 52B and the drive slope surface 62.

The rotary body 30 includes a rotating shaft 80 which connects the curling tongs 10A, 10B and a driven bevel gear 82 which is connected to a drive bevel gear 72 so that the curling tongs 10A, 10B rotates on the rotating axis C when the bevel gears 72, 82 are driven by the drive motor 70.

A rotating shaft 80 is rotatably mounted to a predetermined portion of the fixed body 40 to be longitudinally arranged along the rotating axis C. The rotating shaft 80 is coupled at the first end thereof to the rotary body 30, and has at the second end thereof a driven bevel gear 82 to engage with a drive bevel gear 72. The drive bevel gear 72 is coupled to the drive motor 70 via a reduction gear unit 74.

Further, a direction control button 78 is provided at a predetermined portion of the fixed body 40 to control a rotating direction of the drive motor 70, and a temperature control button 79 is provided at a predetermined portion of the fixed body 40 to control the temperature of the heating plates of the first and second curling tongs 10A and 10B.

A cord 90 having a plug is connected to the fixed body 40 so that electricity is supplied to the hair curling iron 1 through the cord 90. Of course, it is possible to supply electricity to the hair curling iron 1 through an additional charger.

Further, a speed control part 77 is provided at a predetermined portion of the fixed body 40 to allow a user to control rotating speed of the first and the second curling tongs 10A and 10B. That is, the rotating speed of the first and the second curling tongs 10A and 10B is controlled by the speed control part 77.

Figure 6:
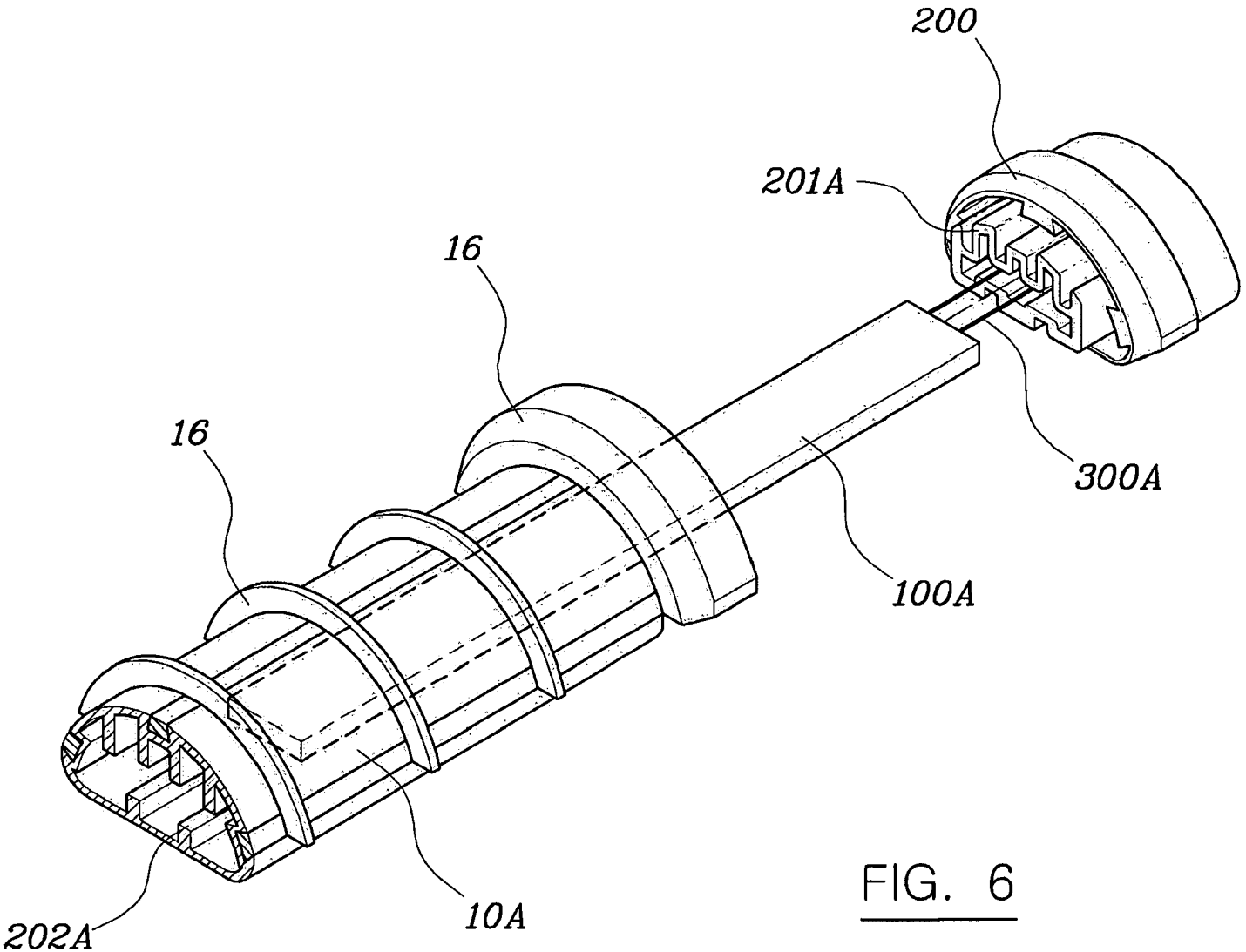
FIG. 6 is an exploded perspective view of a first curling tong of the hair curling iron of FIG. 1.

As shown in FIG. 6, the first curling tong 10A is more fully illustrated. Heat generating means via heating plate 100A is installed inside the first curling tong 10A. Heating plate 100A is supported by supporting rails 202A formed inside tong 10A and also supported by supporting hail 201A formed at the one end (near side of rotary body 30) of the tong 10A. The outside shape of the supporting hall 201A is combined firmly with the supporting rails 202A by admitting the supporting rails 202A therein. To heat the heating plate 100A, electric codes 300A are connected to the heating plate 100A. The surface of the heating plate 100A is covered by thin insulative material (not shown). Because the heating plate 100A can be insulated sufficiently by the covered insulative material, it is not necessary for the supporting rails 202A and the supporting hall 201A to be made of insulative material. Although not shown in FIG. 6, the second curling tong 10B has an identical arrangement for supporting its respective heat generating means via heating plate 100B.

The operation of the hair curling iron 1 constructed as described above is as follows.

The hair curling iron 1 of this invention is normally in closed position which means that the first and the second curling tongs 10A and 10B are in contact with each other by the first and the second elastic springs 20A and 20B. When a user desires to change his or her own hairstyle or other's hairstyle using the hair curling iron 1, the first thing to do is to put the plug of the cord 90 into a socket (electric power source) so that electricity is supplied to the hair curling iron 1. Preferably, at an initial state, the temperature of the heating plates 100A and 100B is set by the temperature control button 79 so that electricity is not supplied to the heating plates of the first and the second curling tongs 10A and 10B or the heating plates are heated at a low temperature.

When the rotating button 64 is pulled toward the fixed body 40 using the user's fingers, the drive unit 60 slides along the rotating axis C. Such a sliding movement of the drive unit 60 acts on the first and the second driven units 50A and 50B through the drive slope surface 62 and the first and the second driven slope surfaces 52A and 52B.

At this time, the first and the second driven units 50A and 50B rotate about the rotary support pin 12 so that the first and the second driven units 50A and 50B come near to each other. Thereby, the first and the second curling tongs 10A and 10B, which move along with the first and the second driven units 50A and 50B, rotate about the rotary support pin 12 so that the first and the second curling tongs 10A and 10B move away from each other, thus resulting in the open state.

Subsequently, a lock of hair is secured between the first and the second curling tongs 10A and 10B, and then the rotating button 64 is released. At this time, the first and the second curling tongs 10A and 10B return to original positions thereof by restoring forces of the first and second elastic springs 20A and 20B, so that the first and the second curling tongs 10A and 10B are closed.

Thus, the lock of hair is placed between the first and the second curling tongs 10A and 10B, that is, between the heating plates 100A and 100B. In such a state, the temperature of the heating plates 100A and 100B is controlled by the temperature control button 79. At this time, the lock of hair secured between the first and the second curling tongs 10A and 10B is heated, thus allowing the user to change the hairstyle as desired, for example, a straight hairstyle.

Meanwhile, when the user desires to change the hairstyle to a wavy or curly hairstyle, the drive button 76 is pressed to rotate the drive motor 70. The rotating force of the drive motor 70 is transmitted to the rotary body 30 through the reduction gear unit 74, the drive bevel gear 72, the driven bevel gear 82, and the rotating shaft 80. Thereby, the rotary body 30 and the first and the second curling tongs 10A and 10B connected to the rotary body 30 rotate about the rotating axis C. Further, when the direction control button 78 is pressed, the rotating direction of the rotary body 30 and the first and the second curling tongs 10A and 10B is changed.

In this way, the curling iron 1 of this invention allows the user to style hair to a variety of styles, including the wavy hairstyle, the curly hairstyle, and the straight hairstyle, without the necessity of changing the heating plates mounted to the first and the second curling tongs 10A and 10B.

Further, the first and the second curling tongs 10A and 10B can rotate clockwise or counterclockwise from original positions thereof to all angular positions, by the drive button 76, thus allowing various hairstyles to be created.

As described above, the present invention provides a hair curling iron comprising a couple of curling tongs that are designed to rotate upward and downward to the fixed angle relative to each other, and further, to rotate as combined together on their own axis, and which allows to create various hairstyles, such as a straight hairstyle, a wavy hairstyle and a curly hairstyle.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A hair curling iron having a pair of curling tongs and a heat generating means installed in the tongs, comprising:

a tong control unit to control the up and down movement of the curling tongs, the tong control unit comprises;

a tong-returning unit to apply a force to said curling tongs so that the curling tongs return to the original closed position;

a tong-opening unit to provide a pivoting force to said curling tongs so that said curling tongs pivot relative to each other by moving said curling tongs upward and downward respectively, the tong-opening unit comprises:

a pair of driven units which extend from said curling tongs and placed at the opposite side of said curling tongs in regard to the rotating axis, and which have driven slope surfaces provided at predetermined positions of each of said driven units to be outwardly inclined from the rotating axis, a drive unit having a drive slope surface to be in contact with said driven units correspondently to have said drive units move inward when it slides back along the rotating axis, and a rotating button designed to have said drive unit slide back along the rotating axis when pulled;

a rotary body connected to the tong control unit to rotatably support the tongs;

a fixed body to support the rotary body so that the rotary body rotates on its own rotating axis;

a drive motor mounted at a predetermined portion of the fixed body to rotate the rotary body; and a drive button to actuate the drive motor.

2. The hair curling iron according to claim 1, wherein said tong-returning unit comprises an elastic spring.

3. The hair curling iron according to claim 1, wherein said rotary body further comprises a rotating shaft which connects the curling tongs and a driven bevel gear which is also connected to a drive bevel gear so that the curling tongs rotate on a rotating axis when said bevel gears are driven by said drive motor.

4. The hair curling iron according to claim 3, wherein said drive bevel gear is coupled to said drive motor via a reduction gear unit.

5. The hair curling iron according to claim 1, further comprising a pair of safety units made of low heat conductivity and less heat deformation to surround outer parts of said curling tongs in such a way as to be separated from the curling tongs.

6. The curling iron according to claim 5, further comprising: a plurality of fitting depressions provided along each of said curling tongs; and a plurality of fitting projections provided on each of said safety units to be inserted in the corresponding fitting depressions.

* * * * *